US006761221B1

(12) United States Patent
Yokley et al.

(10) Patent No.: US 6,761,221 B1
(45) Date of Patent: Jul. 13, 2004

(54) SLIP ASSEMBLY FOR HANGING AN ELONGATE MEMBER WITHIN A WELLBORE

(75) Inventors: John N. Yokley, Kingwood, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/136,969

(22) Filed: May 2, 2002

Related U.S. Application Data

(60) Provisional application No. 60/292,049, filed on May 18, 2001.

(51) Int. Cl.[7] ..... E21B 23/01

(52) U.S. Cl. ..... 166/382; 166/118; 166/208

(58) Field of Search ..... 166/381, 382, 166/118, 208, 209, 216, 217

(56) References Cited

U.S. PATENT DOCUMENTS 3,095,627 A 7/1963 Johnson
4,393,931 A * 7/1983 Muse et al. ..... 166/208
4,569,404 A * 2/1986 Milberger et al. ..... 166/208
4,582,134 A * 4/1986 Gano et al. ..... 166/120
4,773,477 A * 9/1988 Putch ..... 166/206
4,834,185 A * 5/1989 Braddick ..... 166/382
5,146,993 A * 9/1992 Gambertoglio ..... 166/387
5,253,705 A * 10/1993 Clary et al. ..... 166/123
5,301,750 A * 4/1994 Watkins ..... 166/208

OTHER PUBLICATIONS

Publication—Smith Services, "EZ Mechanical Set Liner Hanger" p. 10, (undated).

* cited by examiner

*Primary Examiner*—Frank Tsay
(74) *Attorney, Agent, or Firm*—Browning Bushman, P.C.

(57) ABSTRACT

A slip assembly carried about a liner for lowering into a wellbore includes a C-ring having an inner conical surface contracted about a matching outer surface of the liner and held in contracted position by disposal of its end closely within a recess in the member. When its end is raised from the recess, the c-ring expands to cause its teeth to engage with the wellbore, whereby the liner may be lowered to further expand the c-ring to cause its teeth to dig into the wellbore to suspend the liner therefrom.

13 Claims, 6 Drawing Sheets

SLIP ASSEMBLY FOR HANGING AN ELONGATE MEMBER WITHIN A WELLBORE

RELATED CASE

This application claims the benefit of Provisional Application, Serial No. 60/292,049, entitled "Liner System", and filed May 18, 2001.

FIELD OF THE INVENTION

This invention relates to an improved slip assembly for hanging an elongate member within a wellbore, and more particularly, for hanging a liner within a well casing in the wellbore.

BACKGROUND OF THE INVENTION

Conventionally, a liner or similar elongate member is hung by means of a slip assembly comprising wedge shaped slip elements received in circumferentially spaced relation about the member, each slip element having teeth about its outer side and a downwardly and inwardly conically shaped inner side for sliding over a correspondingly shaped frusto conical wedge surface on the outer side of the member.

The slip elements are held in retracted position, as the liner is lowered into the casing until reaching a desired depth, and then, when so positioned, caused to move over the frusto conical surface of the member so to cause its teeth to grip the casing. When the casing is so gripped, the weight of the liner is slacked off onto the slips in order to transfer the load of the liner to the casing.

One problem with a conventional slip assembly of this type is the need to coordinate the setting of the individual slips so that teeth thereof engage the outer casing substantially simultaneously. Also, it is of course costly to machine multiple wedge surfaces about the liner, as well as to provide multiple slip elements, and it is the principle object of this invention to provide a slip assembly for this purpose which requires only a single slip element cooperable with only a single wedge surface of the liner or other elongate member.

SUMMARY OF THE INVENTION

This and other objects are accomplished, in accordance with the illustrated and preferred embodiment of this invention, by well apparatus which comprises an elongate member adapted to be lowered into and suspended within a wellbore and having a frusto conical surface thereabout, and a circumferentially expandible and contractible, wedge shaped c-ring having slip teeth about its outer side and a frusto conical surface on its inner side. The outer surface of the c-ring is adapted to be installed about the frusto conical surface of the elongate member for sliding between a contracted position, in which the member is free to vertically move in the wellbore, and an expanded position in which the slip teeth engage the wellbore, whereby the weight of the member may be slacked off to hang it from the casing. The member has a recess to receive an end of the c-ring and thus retain the slip in contracted position, and a means is carried by the member for removing the end of the ring from the recess so as to permit the ring to expand as is slides over the conical surface to cause its slip teeth to engage and bite into the wellbore so that the weight of the member may be slacked off onto the casing.

In the illustrated embodiment of the invention, the frusto conical surfaces of the member and slip extend downwardly and inwardly, the lower end of the slip is received in an upwardly facing recess in the member, and the teeth of the c-ring face downwardly in position to engage the wellbore, as the c-ring is raised over the surface of the member whereby the member may be suspended within the wellbore. The means for raising the lower end of the c-ring from the recess to a position for sliding along the conical surface of the member comprises at least one tie bar extending vertically through the member for guided reciprocation with respect thereto. More particularly, the inner side of the c-ring and lower end of the tie bar have interfitting parts which enable the lower end of the c-ring to be raised out of the recess, but which are disengageable when the bar is raised to permit the ring to expand into engagement with the wellbore.

Preferably and as illustrated, the inner frusto conical surface of the c-ring has relatively blunt teeth about its frusto conical surface for engagement with the frusto conical surface of the member so as to control the friction between them, and thus control the applied to the casing.

BRIEF DESCRIPTION OF THE DRAWINGS

As illustrated, the elongate member is a liner and the recess to receive the end of the slip is of annular shape.

In the drawings, wherein like reference characters are used throughout to designate like parts;

FIG. 3BB is enlarged detailed view of a portion of FIG. 3B to illustrate the controlled friction teeth on the inner slide of the c-ring.

FIGS. 3AA and 3BB are detailed sectional views as indicated on FIGS. 3A and 3B. With reference to the above described drawings, and as best shown in FIGS. 3A and 3B, the liner 20 has a downwardly and inwardly extending frusto conical surface 22 thereabout above an upwardly facing annular recess 23. The liner has been lowered on a suitable running tool (not shown) to a position in the outer well casing in which the liner is to be hung off.

DETAILED DESCRIPTION OF PREFERRED EMBODIMENTS

Figure 1A:
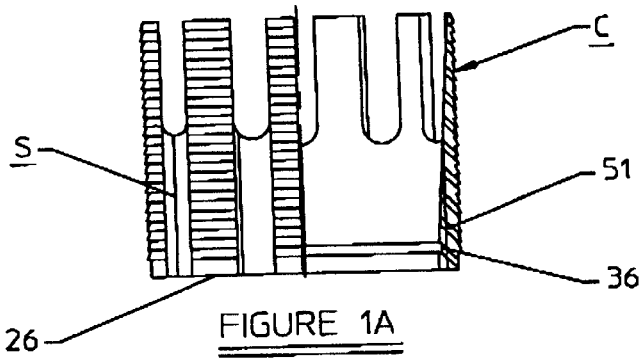
FIGS. 1A and 1B are respectively an elevational view, broken away in part, and an end view of the c-ring along in its fully contracted position wherein its side edges are engaged with one another; the outer side of the c-ring having vertical slots to facilitate the passage of fluid between the liner and outer well casing when the slip is expanded.
Figure 1B:
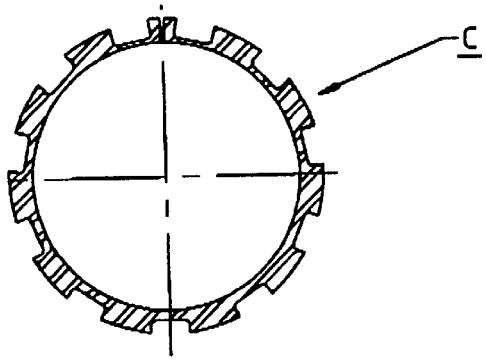

As above described, c-ring C is initially expanded to permit it to be disposed about the conical wedge surface of the liner. It may then be contracted and forced downwardly to cause its lower end 26 to move into the recess 23. When so installed, the c-ring slip is held in retracted position in a shape somewhat larger than its fully contracted shape of FIGS. 1A and 1B.

Figure 2A:
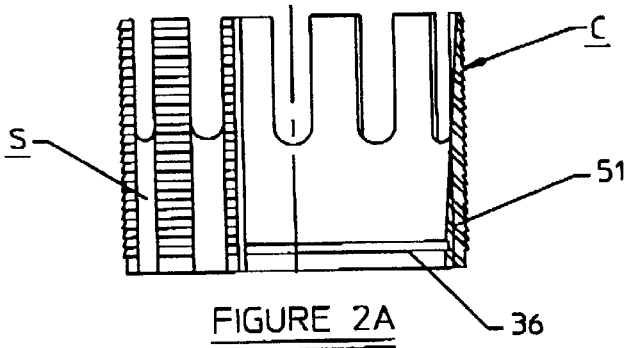
FIGS. 2A and 2B are similar views of the c-ring in fully expanded-position.
Figure 2B:
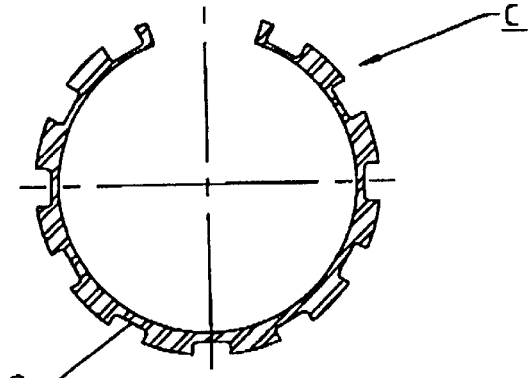
Figure 3A:
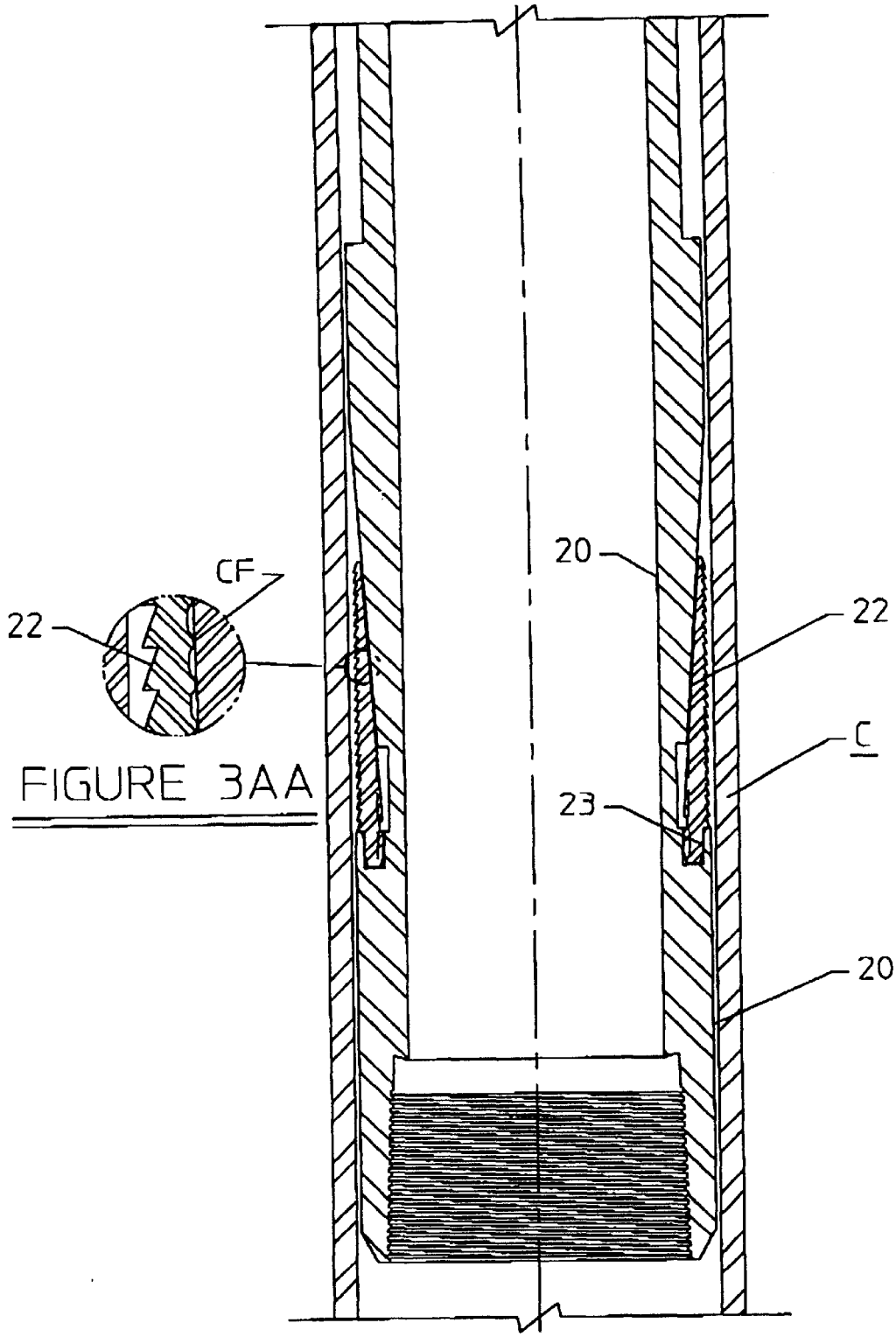
FIGS. 3A and 3B are vertical sectional views of the slip assembly wherein the collapsed c-ring is shown in FIG. 3A disposed about the liner with its lower end received within the recess of the liner, and in FIG. 3B, raised from the recess and expanded to a position in which the liner may be raised to move its outer side upwardly over the frusto conical surface of the liner so as to cause its teeth to engage the well casing.
Figure 3B:
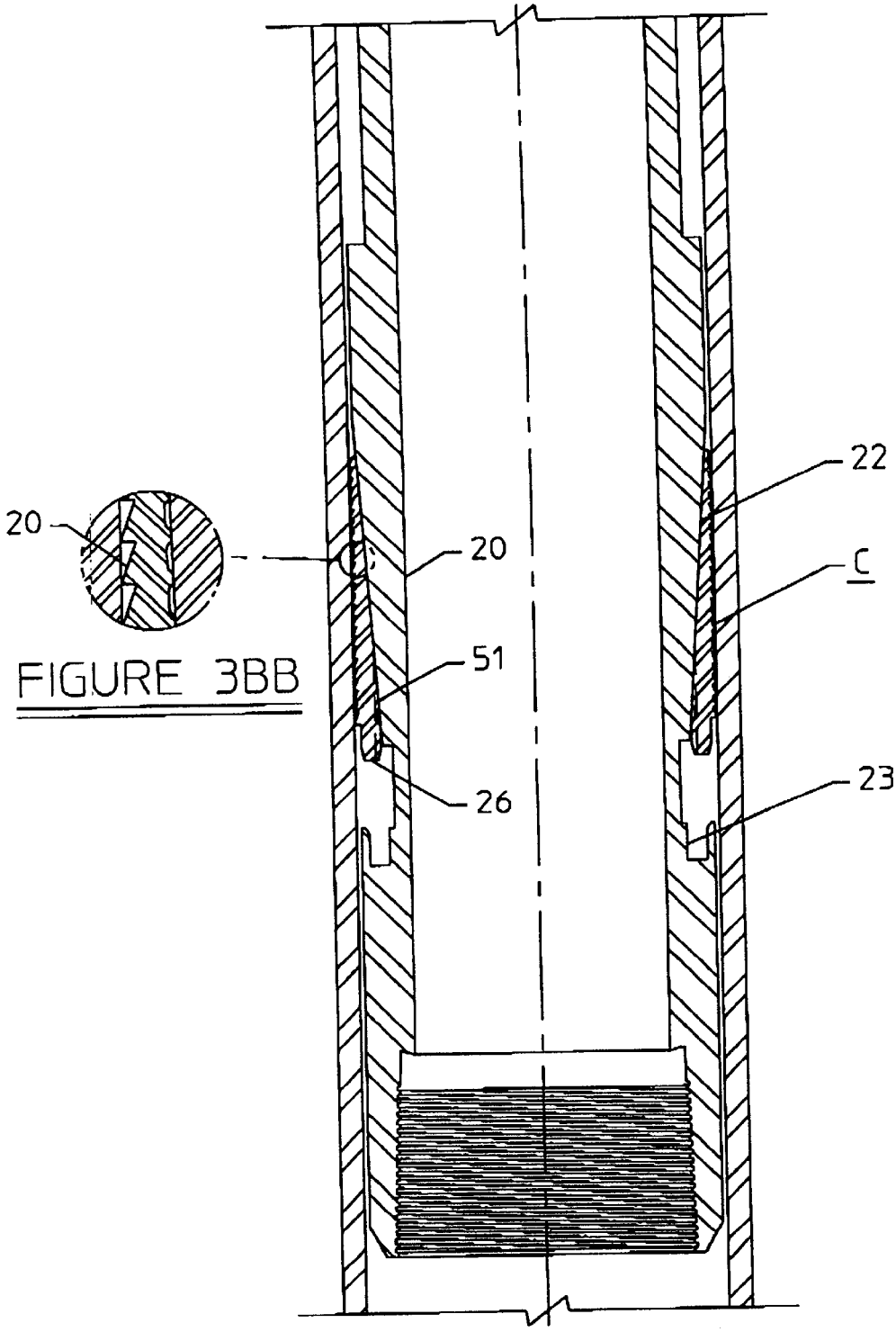

When the c-ring has been pulled upwardly to remove its lower end from the recess 23, it expands towards its fully expanded position of FIGS. 2A and 2B, whereby downwardly facing teeth 22 about its outer side engage the outer well casing, as shown in FIG. 3B, in a somewhat less than fully expanded position. Then, when the c-slip is raised, the inner surface of the c-ring will slide over wedge surface 22 to urge it outwardly to cause its teeth to bite into the outer well casing, and thus permit the weight of the liner and its associated parts to be hung off on the casing.

As shown in FIGS. 3A and 3B and in detail in FIGS. 3AA and 3BB, the inner frusto conical surface of the c-ring slip has blunt teeth CF thereon to control the frictional engagement with the liner and thus the outward force applied to the casing. Thus, as the teeth take on initial bite into the casing, the blunt teeth on the inner side of the slip will begin to gall the wedge surface of the liner so as to control the extent to which the teeth bite into the casing. The force thus applied to the casing and liner may be controlled by the relationship of the inner and outer teeth to one another. Although the teeth CF are preferred, the inner surface of the c-ring may be smooth.

Figure 4:
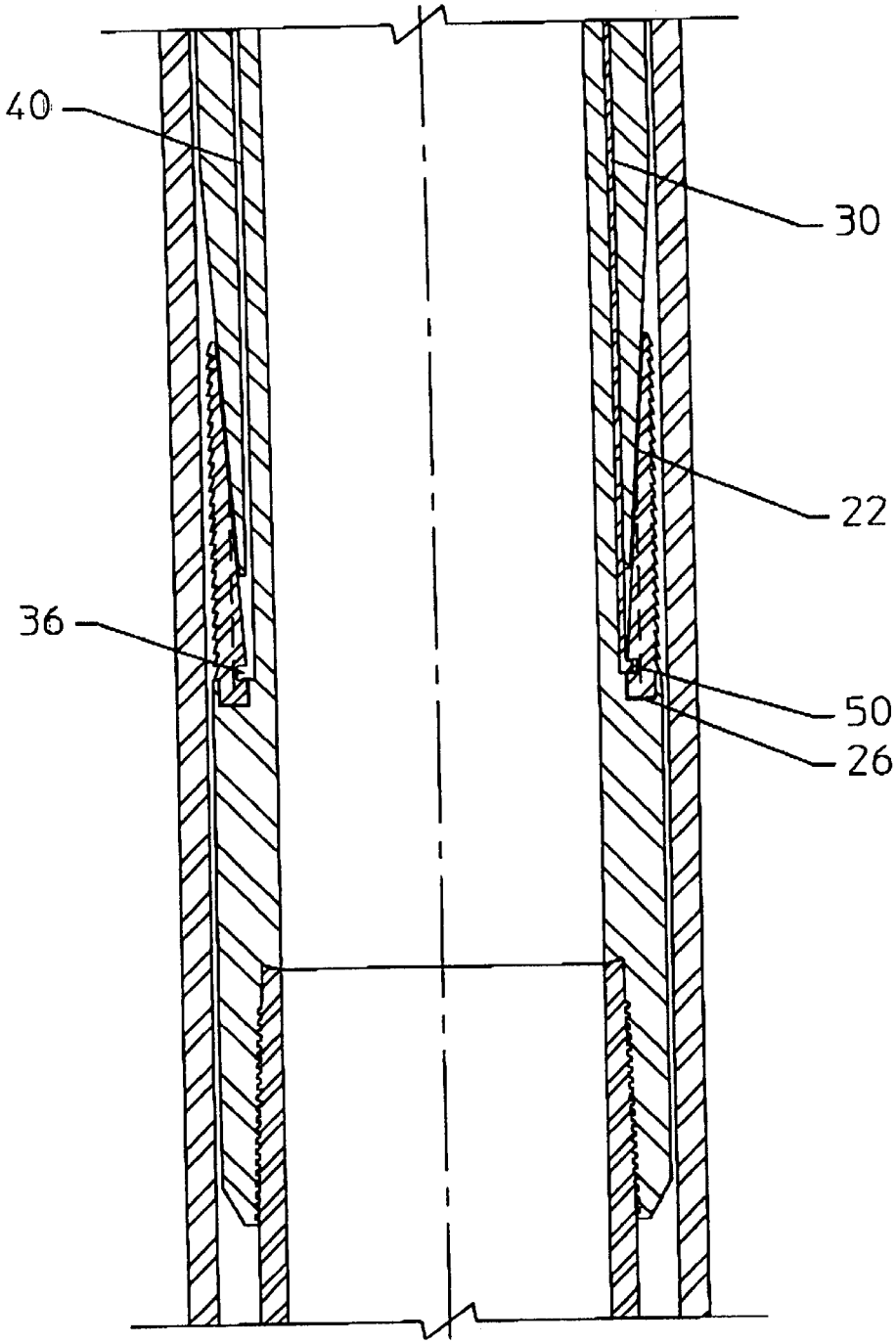
FIGS. 4, 5, and 6 are enlarged vertical sectional views of the assembly showing the c-ring as it moved by the liner from the retracted to the expanded position, the c-ring being shown in retracted position in FIG. 4, raised out of the recess by the tie bar in FIG. 5 to release it for expanding outwardly to engage the casing, and, in FIG. 6, the tie bar has raised frusto conical surface of the liner over the inner surface of the c-ring to cause the c-slip to be moved outwardly into engagement with the well casing.
Figure 5:
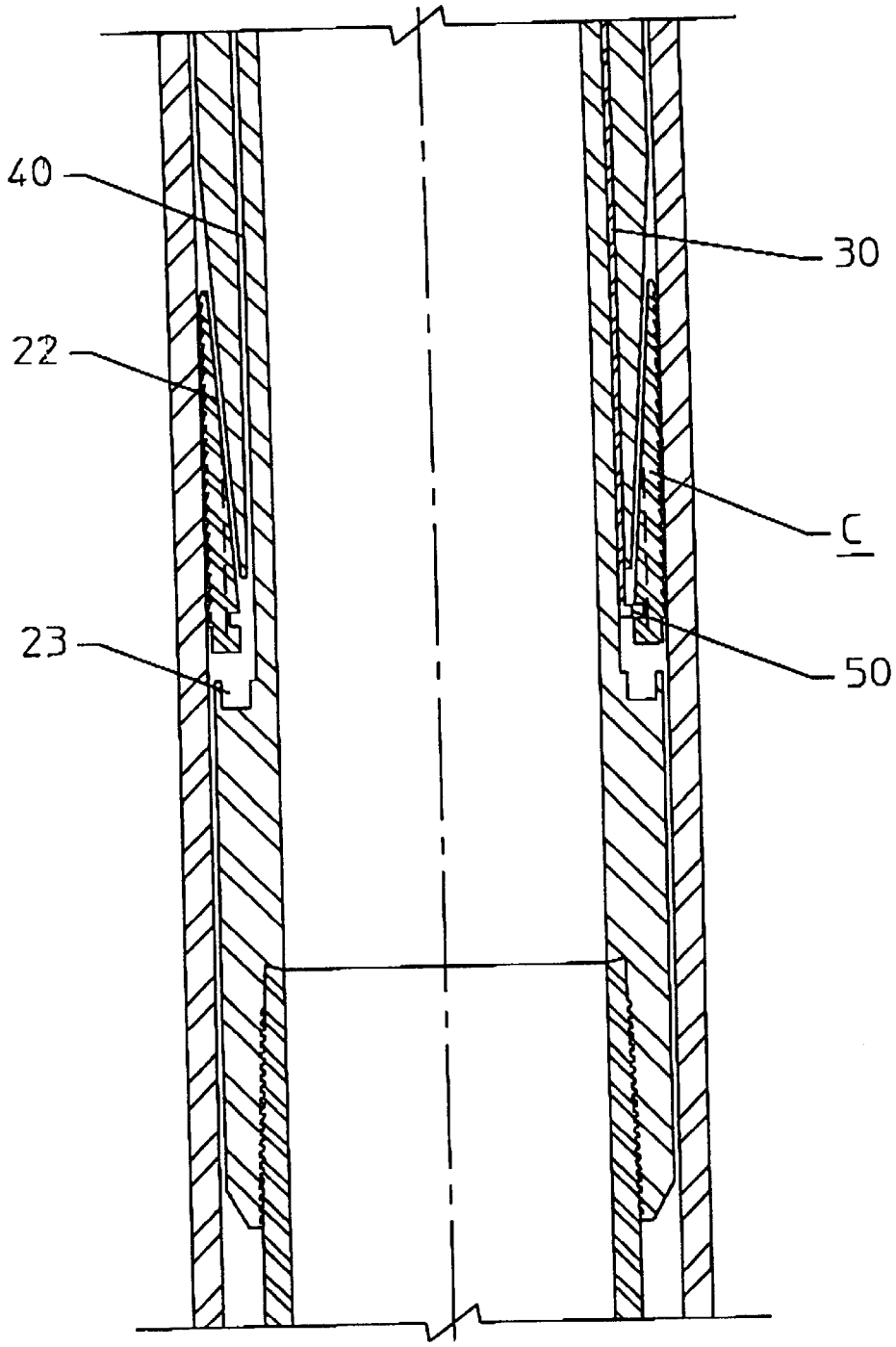
Figure 6:
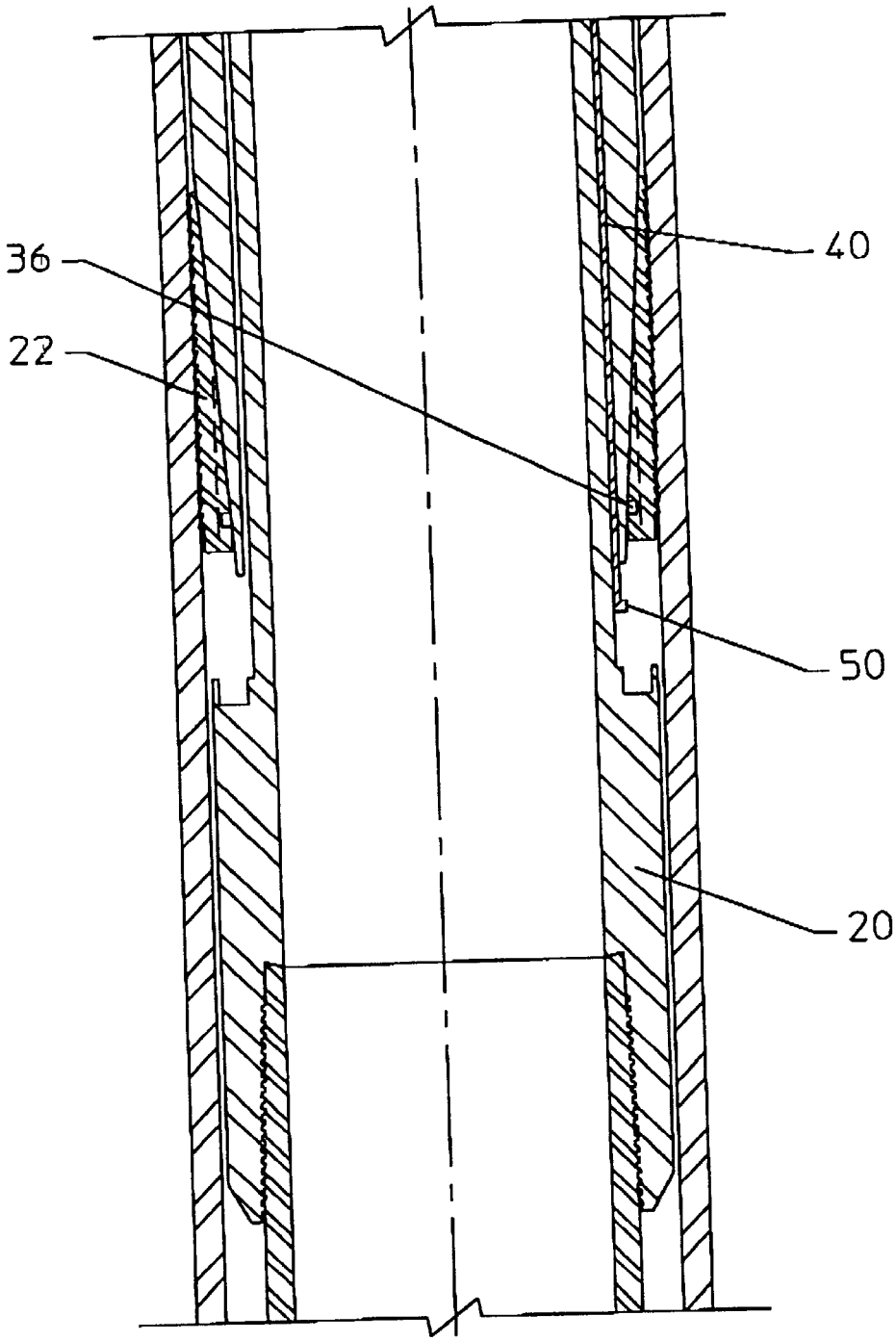

With reference to FIGS. 4 to 6, one or more tie bars 30 extend downwardly through a slot 40 in the liner for guided reciprocation with respect thereto. The lower end of each tie bar is connected to the upper end of the slip for raising its lower end out of the recess. Thus, as shown in FIGS. 4–6, the lower end of each tie bar 30 has a flange 50 which is received in a groove 36 about the inner diameter of the c-ring, as the c-ring is initially mounted in the recess.

As the tie bar is raised to lift the c-ring out of the recess 23, the flange 50 on its lower end moves out of the groove 36 to release the c-ring therefrom, as shown in FIG. 5. At this time, of course, the weight of the liner may be slacked off on to the outer frusto conical surface of the c-ring to force the teeth of the c-ring outwardly into gripping engagement with the outer casing as shown in FIG. 6.

As above mentioned, in an alternative embodiment of the invention, the frusto conical surface on the liner and slip may extend upwardly and inwardly. In this case, a tie bar or other means for releasing the c-ring would be guidably mounted in the liner in a manner to permit the c-ring to be pulled downwardly to release its upper end from a recess in the liner above it.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A liner hanger for hanging a liner in a wellbore from a well casing, comprising:

a setting member for lowering the liner into the wellbore and having an outwardly facing frustoconical surface tapered downwardly and radially inward; and a circumferentially and radially expandable and contractable c-ring having slip teeth about its outer side and a frustoconical surface tapered upwardly and radially outward on its inner side for cooperation with the frustoconical surface on the setting member, the c-ring being moveable between a radially contracted retained position in which the c-ring is spaced from the well casing and an expanded position in which the c-ring engages an interior surface of the well casing;

the setting member including a recess to receive an end of the c-ring and a stop radially outward of a portion of the recess to retain the c-ring in the contracted position on the setting member as the liner is lowered in the well, and upon axial movement of the c-ring relative to the stop, the c-ring expands toward the expanded position so that the slip teeth engage the well casing, such that the liner may be hung from the interior surface of the well casing upon lowering the frustoconical surface on the setting member relative to the c-ring.

2. A liner hanger as defined in claim 1, where the stop is stationary with respect to the setting member, and the c-ring moves axially upward to disengage the stop.

3. A liner hanger as defined in claim 1, further comprising:

a tie bar axially moveable within the setting member to move the c-ring relative to the stop, the c-ring and tie bar having interfitting parts to interconnect the tie bar and the c-ring until the c-ring disengages the stop and then release the tie bar from the c-ring upon lowering of the setting member.

4. A liner hanger as defined in claim 1, wherein the c-ring is slidable over the frustoconical surface of the setting member as the liner is lowered by gravity to cause the teeth to bite the interior surface of the well casing.

5. A liner hanger as defined in claim 1, further comprising:

a plurality of blunt inner teeth along the inner frustoconical surface of the c-ring for frictional engagement with the frustoconical surface on the setting member.

6. A liner hanger for hanging a liner in a wellbore from a well casing, comprising:

a setting member for lowering the liner into the wellbore and having an outwardly facing frustoconical surface tapered downwardly and radially inward;

a circumferentially and radially expandable and contractable c-ring having slip teeth about its outer side and a frustoconical surface tapered upwardly and radially outward on its inner side for cooperation with the frustoconical surface on the setting member, the c-ring being moveable between a radially contracted retained position in which the c-ring is spaced from the well casing and an expanded position in which the c-ring engages an interior surface of the well casing;

the setting member including a recess to receive an end of the c-ring and a stop stationary with respect to the setting member and radially outward of a portion of the recess to retain the c-ring in the contracted position on the setting member as the liner is lowered in the well, and upon axial movement of the c-ring relative to the stop, the c-ring expands toward the expanded position so that the slip teeth engage the well casing, such that the liner may be hung from the interior surface of the well casing upon lowering the frustoconical surface on the setting member relative to the c-ring; and a tie bar axially moveable relative to the setting member to move the c-ring relative to the stop.

7. A liner hanger as defined in claim 6, further comprising:

the c-ring and tie bar having interfitting parts to interconnect the tie bar and the c-ring until the c-ring disengages the stop and then release the tie bar from the c-ring upon lowering of the setting member.

8. A liner hanger as defined in claim 6, further comprising:

a plurality of blunt inner teeth along the inner frustoconical surface of the c-ring for frictional engagement with the frustoconical surface on the setting member.

9. A method of suspending a liner within a wellbore from a well casing, comprising:

providing a setting member for lowering the liner within the wellbore and having an outwardly facing frustoconical surface tapered downwardly and radially inward;

providing a circumferentially expandable and contractable c-ring having slip teeth about its outer side and a frustoconical surface on its inner side for cooperation with the frustoconical surface of the setting member, the c-ring being moveable between a radially contracted retained position in which the slip teeth are spaced from the well casing and an expanded position in which the slip teeth engage an interior surface of the well casing;

compressing the c-ring on the setting member to its contracted position and retaining an end of the compressed c-ring within a recess in the setting member with a stop to prevent the c-ring from moving radially outward to the expanded relaxed position;

when the liner is desirably positioned in the wellbore, moving the c-ring axially with respect to the stop to release the c-ring to expand such that the slip teeth engage the well casing; and moving the frustoconical surface of the setting member downward to force the slip teeth to bite the well casing, such that the liner is hung from the interior surface of the well casing.

10. A method as defined in claim 9, wherein the stop is fixed to the setting member and the c-ring moves axially upward to disengage the stop.

11. A method as defined in claim further comprising:

providing a tie bar axially moveable within the setting member;

interconnecting the tie bar and the c-ring until the c-ring disengages the stop; and thereafter releasing the tie bar from the c-ring for expansion of the c-ring upon lowering of the setting member.

12. A method as defined in claim 9, further comprising:

providing a plurality of blunt inner teeth along the inner frustoconical surface of the c-ring for frictional engagement with the frustoconical surface on the setting member.

13. A method as defined in claim 9, wherein the setting member is moved downward by its weight.

* * * * *